United States Patent [19]

Kofol et al.

[11] Patent Number: 4,885,592

[45] Date of Patent: Dec. 5, 1989

[54] ELECTRONICALLY STEERABLE ANTENNA

[76] Inventors: J. Stephen Kofol, 665 Roble Ave., Apt C, Menlo Park, Calif. 94025; Daniel A. Schroepfer, 2857 Flag Ave. N., Apt. 1G, New Hope, Minn. 55427

[21] Appl. No.: 138,409

[22] Filed: Dec. 28, 1987

[51] Int. Cl.[4] ..... H01Q 13/10

[52] U.S. Cl. ..... 343/754; 343/770; 343/771; 342/372

[58] Field of Search ..... 342/368, 371, 372, 377, 342/374, 376; 343/768, 770, 771, 753, 754, 909

[56] References Cited

U.S. PATENT DOCUMENTS

| | | | |
|---|---|---|---|
| 2,801,412 | 7/1957 | Mayburg et al. | 343/753 |
| 3,311,917 | 3/1967 | Thourel | 343/771 |
| 3,345,631 | 10/1967 | Chamberlin, Jr. | |
| 3,392,393 | 7/1968 | Spitz | 343/750 |
| 3,478,358 | 11/1969 | Trigon | |
| 3,534,374 | 10/1970 | Johnson | 343/771 |
| 3,604,012 | 9/1971 | Lindley | |
| 3,680,110 | 7/1972 | Goldstone | |
| 3,909,829 | 9/1975 | Daly | 342/377 |
| 3,969,729 | 7/1976 | Nemit | |
| 4,217,587 | 8/1980 | Jacomini | |
| 4,229,739 | 10/1980 | Smith | |
| 4,229,745 | 10/1980 | Kruger | |
| 4,277,787 | 2/1981 | King | |
| 4,297,708 | 10/1981 | Vidal | |

*Primary Examiner*—Rolf Hille
*Assistant Examiner*—Michael C. Wimer
*Attorney, Agent, or Firm*—John G. Shudy, Jr

[57] ABSTRACT

A lightweight antenna array which can quickly scan or switch radiation patterns, characterized by an array of slot-type radiators wherein the impedance of each radiating element can be varied, preferably by a computer controlled circuit containing particular groups of the radiators, wherein each grouping is defined by a unique set of impedance values for the radiators. The groups of radiators in the array can be slectively generated to scan and/or switch pattern footprints and/or change near-field radiation characteristics and/or alter antenna aperture size, density, distribution, spacing or frequency of operation. An adaptive technique, using an algorithm, can be employed to generate the radiator groupings.

9 Claims, 10 Drawing Sheets a, b = ROW, COLUMN

100 ELEMENT SLOTTED ARRAY (10 X 10)

OPEN SLOTS FOR A ZERO DEGREE BEAM POSITION

OPEN SLOTS FOR A 30 DEGREE BEAM POSITION

| | | | | | | | | | |
|---|---|---|---|---|---|---|---|---|---|
| A | C | E | C | C | C | C | E | C | A |
| A | C | E | C | A | A | C | E | C | A |
| A | C | E | C | C | C | C | E | C | A |
| B | A | C | E | E | E | E | C | B | B |
| C | A | B | C | C | C | C | B | A | C |
| E | C | A | A | A | A | A | A | C | E |
| E | E | C | C | C | C | C | C | E | E |
| C | D | E | E | D | D | E | E | D | C |
| A | C | C | C | C | C | C | C | C | A |
| C | A | A | A | A | A | A | A | A | C |

SLOT ELEMENT
PHASE PLATE DELAY

A = 0.79π
B = 1.17π
C = 1.55π
D = 1.93π
E = 2.31π

*Fig. 11b*

OPEN RADIATOR GROUPING FOR A 0° DIRECTION MAIN BEAM

COMPUTED ANTENNA PATTERN FOR BEAM DIRECTION (ø = 0°, θ = 0°)

OPEN RADIATOR GROUPING FOR A 14.3° DIRECTION MAIN BEAM

COMPUTED ANTENNA PATTERN FOR BEAM DIRECTION (ø = 0°, θ = 14.3°)

COMPUTED ANTENNA PATTERN FOR BEAM DIRECTION (ø = 0°, θ = 28.6°)

OPEN RADIATOR GROUPING FOR A 28.6° DIRECTION MAIN BEAM

ELECTRONICALLY STEERABLE ANTENNA

BACKGROUND OF THE INVENTION

1. FIELD OF THE INVENTION

This invention relates to antennas employing a single or multitude of slot-type radiators in a conductive medium, wherein the state of radiation for single or selected groups of radiators is altered to thereby provide selected radiation patterns.

2. RELATED ART

Antenna arrays and phase-scanned antenna arrays are well known. An array is a multitude of radiators, not necessarily in a regularly spaced arrangement. Each radiator is not always identical to the other. Typically, the arrays provide a selected set far-field pattern by varying the phase of the electromagnetic energy fed to selected radiating elements. Scanning involves rotating a given far-field pattern in space, usually in a selected plane. A slot-type radiator is usually an opening in a conductive medium, whereby electromagnetic energy is radiated from the opening, most often shaped like a rectangle, ring, "Y" or cross. Such radiator can be similar to an implementation where the dipole equivalent of a slot is realized as a dielectric shape on a background of material of a different dielectric constant.

Chamberlin, in U.S. Pat. No. 3,345,631, discloses a phased array radar scan control. Chamberlin applies phase shifted pulses to rows and columns of slot radiators to vary the phase of the electromagnetic energy at each slot and thereby scan the antenna beam.

Lindley in U.S. Pat. No. 3,604,012 switches the radiative state of selected coupled pairs of slots to reverse the phase of the energy radiated by the pair and thus scan an antenna beam.

Nemit in U.S. Pat. No. 3,969,729 spaces radiator slots a quarter of a wavelength apart to provide various phase states for each radiator "element". The net phase of the aperture of the element is set to one of the possible phase states by opening selected slots in the element. Nemit uses his elements in phase scanned arrays.

When scanning a far-field pattern, distortion is generally increased as the pattern is moved from broadside, but the general far-field pattern is preserved. The aperture size is also generally preserved during scanning Not disclosed in the related art is an array which can scan very fast and shift pattern footprints fast as well as allow for large changes in operating frequency, that is, an array which can quickly shift the relative amplitude and position of the main beam(s) and side lobes as well as scan by rotating a particular radiated pattern. Further, the related art does not provide an array which can quickly vary the aperture size and thus sharpen and intensify the far-field pattern. This technique also has potential for a low recurring-cost design.

SUMMARY OF THE INVENTION

An electronically steerable antenna includes an array of slot-type radiators each capable of being open, closed or placed in some intermediate impedance condition. The relative phase of the signal available at each radiator is fixed by hardware for each grouping of radiators and their specific radiation state. (Variations in this phase occur due to mutual interactions for each array grouping.) By adjusting the impedance (or equivalently, by varying the slot radiation efficiency) of selected slots, the radiated pattern is established, and by changing the impedance values for a selected grouping of slots, the pattern can be altered. Such alteration includes scanning a far-field pattern, generating a different pattern footprint or switching to a different grouping of radiators to operate at a different frequency.

The invention is particularly suited for digital applications where the radiators are in one of two states, i.e., either open or closed.

The array of radiating elements is fed by any of appropriate transmission media; examples being: stripline, microstrip, waveguide, co-planar, coaxial, cavities, etc. Each radiator is switched independently of the others. The aperture size can be varied quickly by switching large segments of radiators on or off together.

Grouping of appropriate radiators is conveniently determined by an adaptive programming technique which employs an algorithm. The invention is particularly suited to an integrated, monolithic array structure particularly useful at millimeter-wave frequencies.

BRIEF DESCRIPTION OF THE DRAWINGS

FIG. 11*b* shows fixed phase delay at each radiator due to the phase plate.

DESCRIPTION OF THE PREFERRED EMBODIMENT

Similar structure between the figures is like-numbered for clarity.

Figure 1:
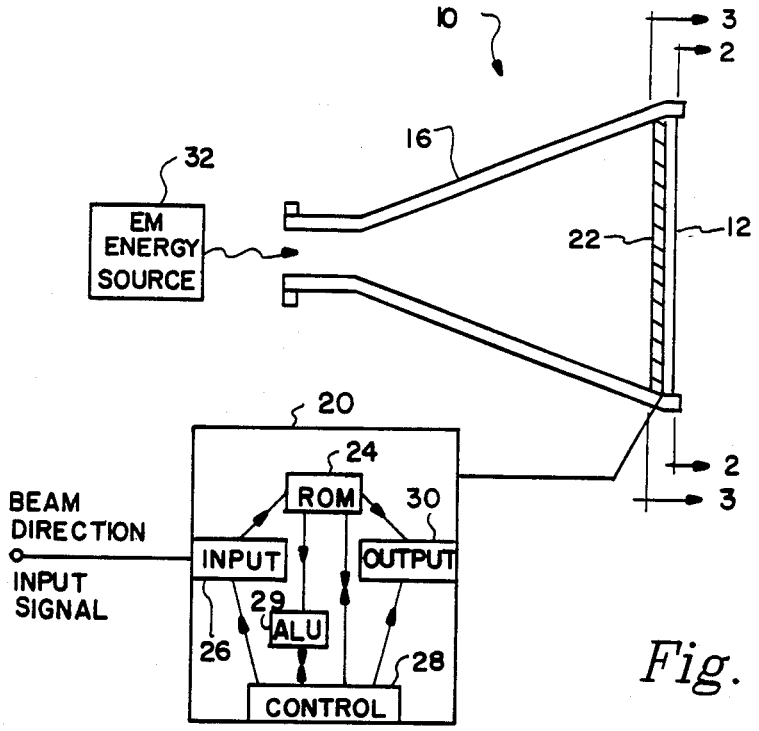
FIG. 1 is a cutaway plan view of an embodiment of the present invention.
Figure 2:
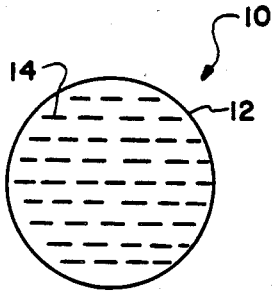
FIG. 2 is a section view of FIG. 1 taken along line 2—2.
Figure 3:
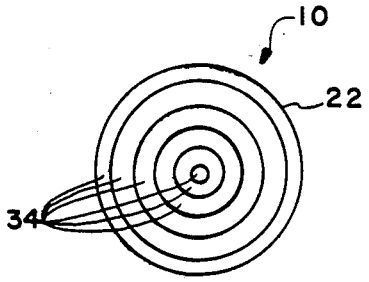
FIG. 3 is a section view of FIG. 2 taken along line 3—3.
Figure 4:
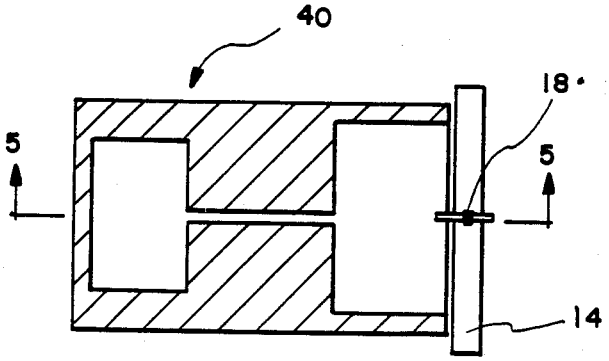
FIG. 4 is a plan view of an individual radiating slot and bias filter.

Antenna 10 (see FIGS. 1, 2 and 3) includes a conductive member 12 (wherein a plurality of radiating elements such as rectangular slots 14 are formed), means for directing electromagnetic (EM) energy onto conductive member 12 and slots 14(such as horn feed 16), means for varying the impedance or slot radiation efficiency of at least some of slots 14 (such as PIN diodes 18 of FIG. 5 in conjunction with digital control circuit 20), means for setting the relative phase of EM energy fed to slots 14 (such as phase plate 22), means for storing data indicative of groupings of slots 14 (such as ROM 24) and means for selecting among the groups of slots 14 (such as microprocessor input 26, control 28, ALU 29 and output 30). The impedance of each slot is varied independently of the other slots.

Phase plate 22 varies in thickness to retard the phase of EM energy fed from source 32 to slot 14 by different amounts. In the example of antenna 10, EM energy from source 32 is a spherical wave it reaches phase plate 22. The stepped ring 34 of phase plate 22 differs in thickness by selected fractions of the wavelength of the source EM energy (in the dielectric medium of the phase plate) and provides a large number of phase states at slots 14 from which to select.

Groups of radiating elements in ROM 24 are (preferably) each defined by a unique set of impedance values for the individual slots 14. The different groupings of slots can be selected to scan a single far-field EM energy pattern (i.e., rotate the far-field pattern in space while keeping the relationship of the lobes essentially constant), selected so that each slot grouping or arrangement results in a different far-field EM energy pattern or footprint (i.e., the relative size, relationship and/or number of the lobe changes), or different groups can be selected, each with a different operating frequency, that will allow operating with frequency diversity.

Figure 5:
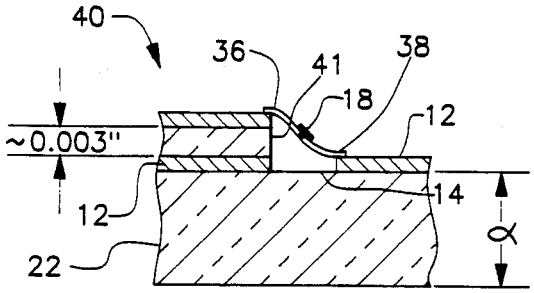
FIG. 5 is a partial sectional view of FIG. 4 taken along line 5—5.
Figure 6:
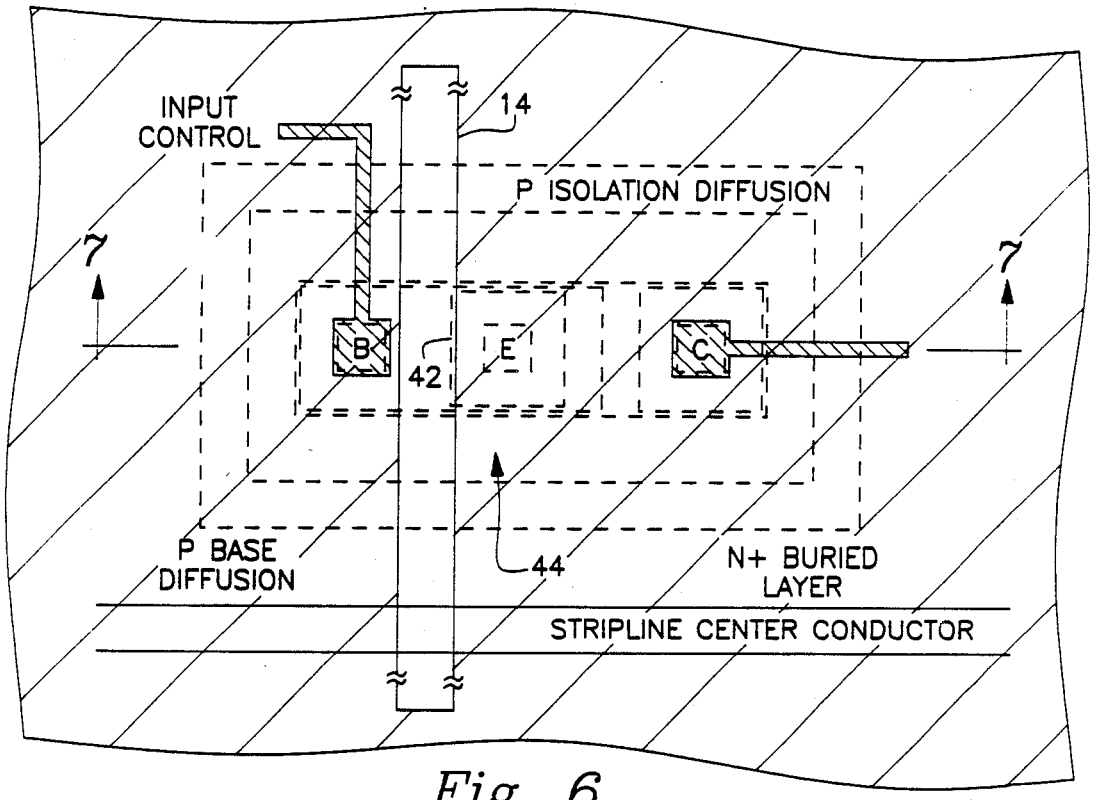
FIG. 6 is a monolithic slot and switching transistor.

A useful means of varying the impedance of selected slots 14 is to use PIN diode 18. FIGS. 5 and 6 show one form of diode 18 (employing beam leads 36 and 38) in conjunction with bias filter 40. Output signals from digital control circuit 20 are passed to bias filter 40 to control diode 18. Layer 41 of bias filter 40 is typically 0.003 to 0.010 inch thick. Phase is set by thickness $\alpha$ of phase plate 22 which can vary from zero to infinity. The practical thickness would be from zero to $\lambda$, depending on the dielectric constant ($\epsilon_r$, permittivity) of the phase plate 22 material.

Figure 7:
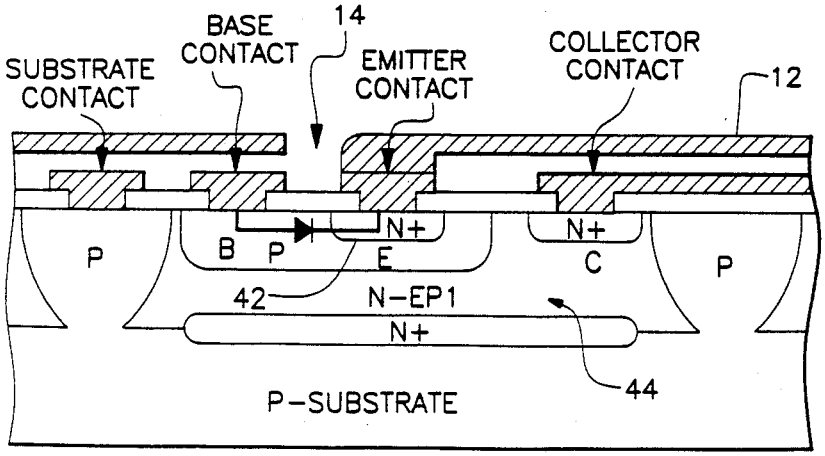
FIG. 7 is a section view of FIG. 6 taken along line 7—7.

FIGS. 6 and 7 show an example of another impedance varying means, a monolithic slot 14 and switching transistor 44 arrangement. Therein a base-emitter junction 42 of a planar bipolar transistor 44 serves to vary the impedance across slot 14 in response to variations of the voltage applied across junction 42 from the input control line connected to the base contact. A slight modification changing FIGS. 6 and 7 to an emitter follower implementation would provide better switch performance. Similarly other designs and/or other semiconductors could be used to further enhance performance. For instance, a hetero-junction GaAs design would avoid the poor RF performance of the p base material in FIGS. 6 and 7 as well as offer a better low impedance "on" state.

Figure 8:
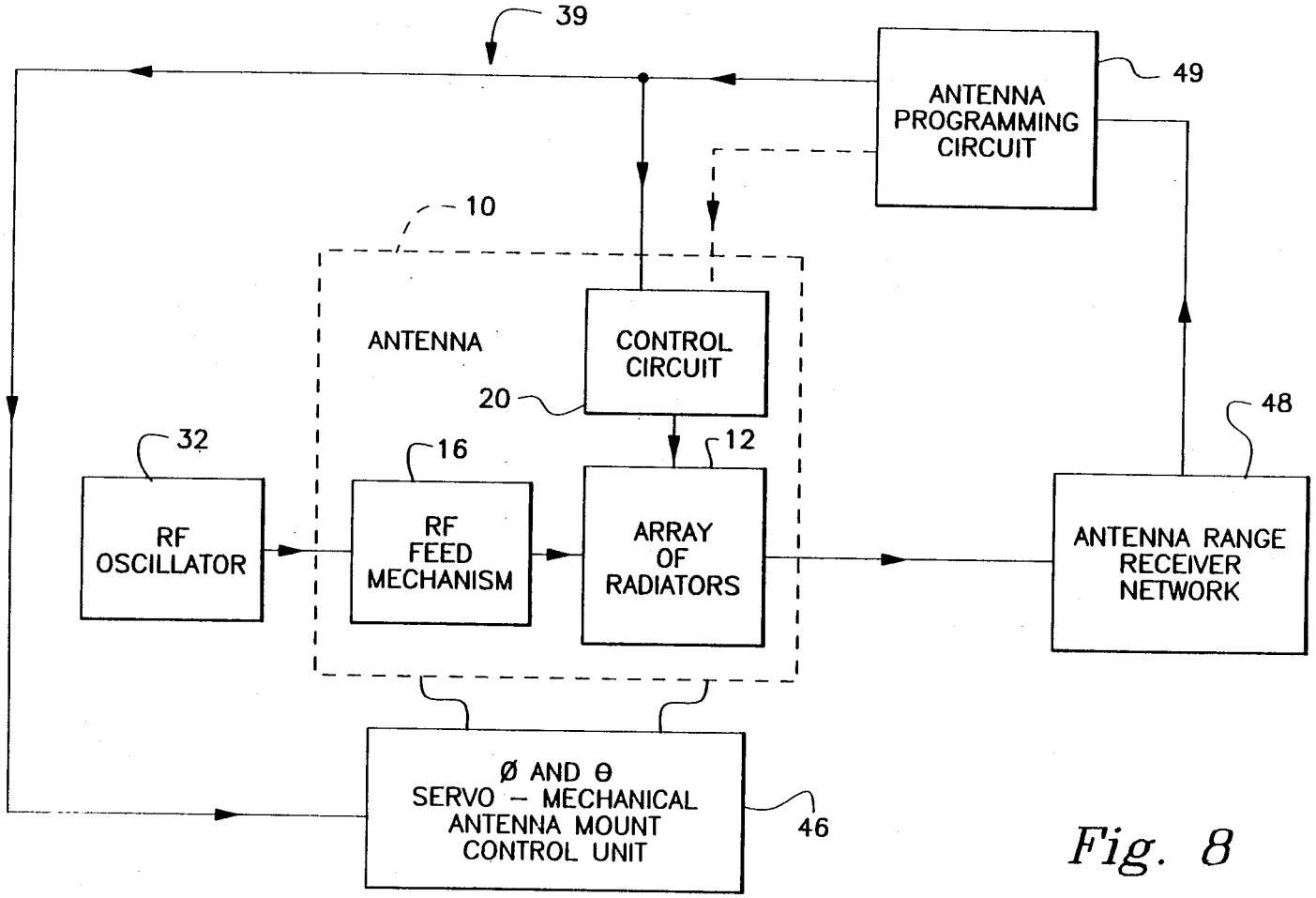
FIG. 8 is a schematic of an adaptive system for programming the array control circuit.
Figure 9A:
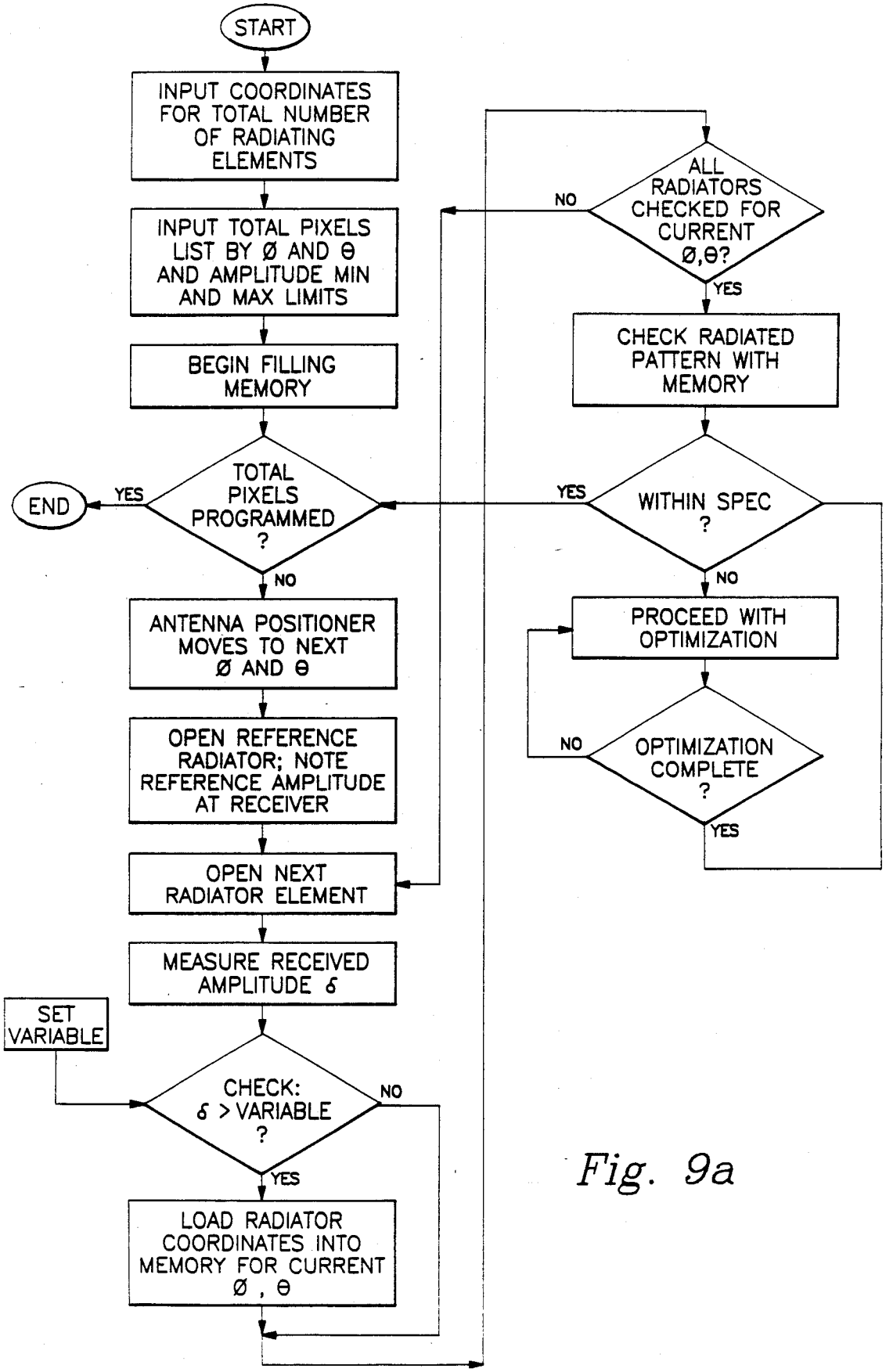
FIG. 9*a* is an algorithm employed in the system of FIG. 8.
Figure 9B:
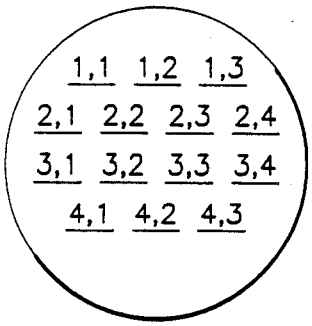
FIG. 9*b* is an example of a slot array used with the algorithm of FIG. 9*a*.
Figure 9C:
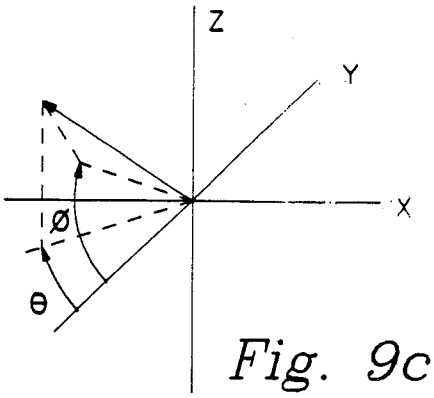
FIG. 9*c* is a coordinate system used with the algorithm of FIG. 9*a*.
Figure 9D:
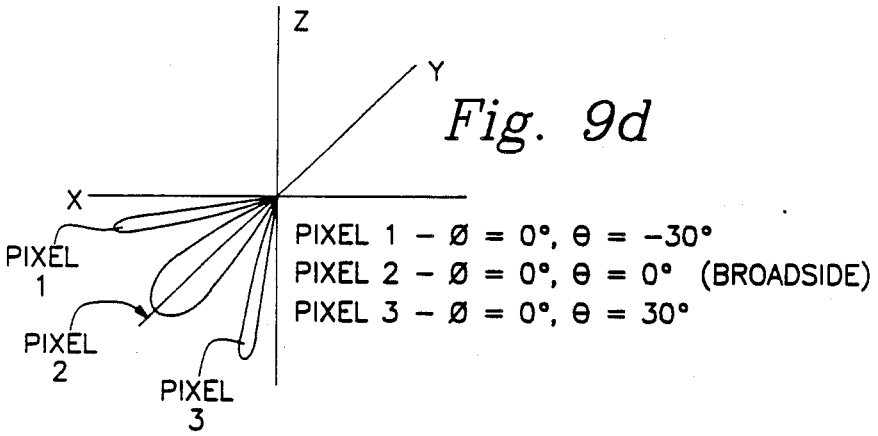
FIG. 9*d* shows examples of 3 pixels used with the algorithm of FIG. 9*a*.

Control circuit 20 can be implemented in various ways; however, the adaptive system 39 of FIG. 8, operating in conjunction with the algorithm of FIG. 9*a*, is preferred. In this way, control circuit 20 is digital and is programed using the adaptive system 39. FIG. 9*b* and 9*c* depict a numbering system for a slot array and a coordinate system which are useful in applying the algorithm of FIG. 9*a*. FIG. 9*d* shows 3 "pixels" (i.e., the sampling point direction of a far-field pattern) to be processed by the algorithm of FIG. 9*a*.

FIG. 9*a* is applied as follows: the total number of radiating elements in the array are entered with identifying coordinates, and the coordinates for the desired pixels and their associated amplitude limits are entered. Antenna 10 is moved to the appropriate coordinates for the first pixel by servo unit 46. One of the slots 14 in FIG. 9*b* is used as a reference. The reference slot remains open while the remainder of the slots are individually opened. As each of the remainder of the slots 14 are opened, the effect on the amplitude of the particular pixel being tested is noted (by, for example, sensing the field in receiver 48 and determining the variation from the previous amplitude value by computations in antenna programming circuit 49). If the variation in amplitude exceeds a selected value (designated by $\delta$) then the coordinates of the radiator slot are entered into memory in ROM 24 by programming circuit 49. If the variation is less than or equal to $\delta$, the slot will remain closed for the pixel and its coordinates are not entered in ROM 24. All slots are tested in this manner for each pixel.

Additionally, the algorithm in FIG. 9*a* can include another branch where, after all slots are checked for a particular pixel or set of pixels, the resultant far-field pattern is checked against the desired far-field pattern. The desired far-field pattern could, for example, be held in a portion of ROM 24 and the amplitude of the far-field pattern generated by a particular group of slots 14 can be compared to selected portions of the desired far-field pattern to see if the patterns match (i.e., if they are within specifications). If the pattern is within the specifications, typically the algorithm will be terminated; however, an attempt to improve the match can be made. If the specifications are not met, an optimization routine would be invoked, which would involve, for example, changing $\delta$ and repeating the algorithm of FIG. 9*a*. The time required by the iterative adaptive algorithm process for creating an optimized far-field pattern can be reduced by altering the algorithm to include a starting point for a particular grouping of slots in the array. A computer code to calculate this starting point has been generated for the creation of sum-patterns scanned to different angles.

The radiator spacing, total aperture size and phase due to phase setting hardware at each radiator are entered as inputs. Physical characteristics of the feed structure are also taken into account. The computer then calculates which slots are to be opened for each main beam direction chosen. Theoretical far-field patterns can also be plotted. These predictions do not take into account mutual coupling from one radiating element to another. These effects are significant; however, the groups of slots predicted to yield desired far-field patterns offer an excellent starting point for the algorithm to start optimizing.

Figure 14A:
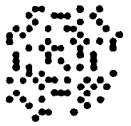
FIGS. 14*a*, 14*b*, 15*a*, 15*b*, 16*a* and 16*b* show examples of slot groupings and associated far-field calculations
Figure 14B:
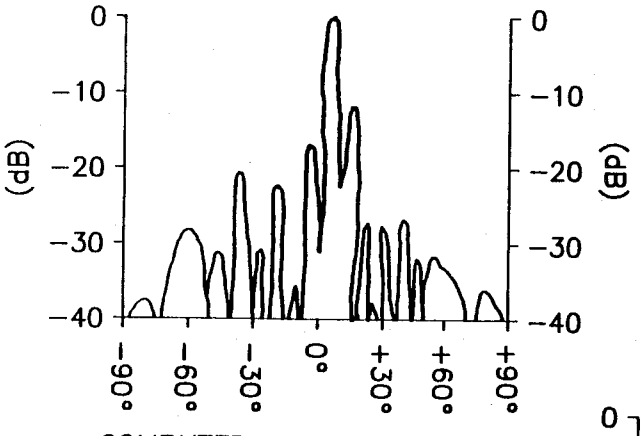
Figure 15A:
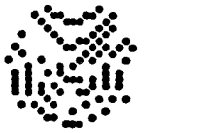
Figure 15B:
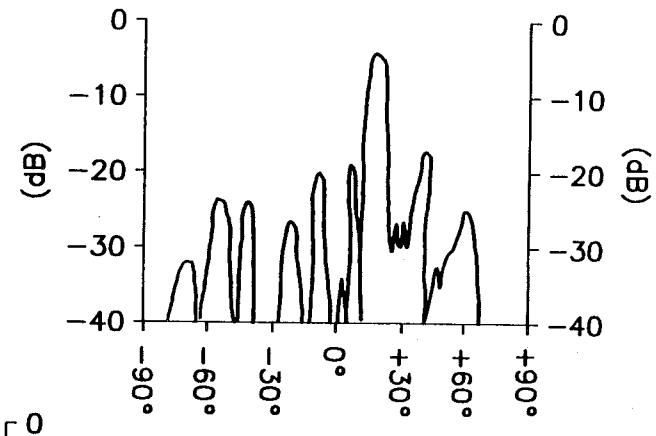
Figure 16B:
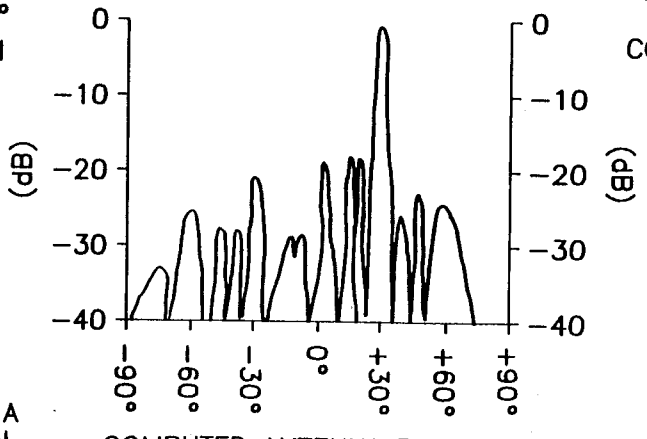
Figure 16A:
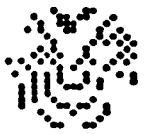

Three examples of slot grouping and their associated theoretical far-field calculations are shown in FIGS. 14, 15 and 16. The total aperture consists of 304 slot radiator elements in a circular area with rectangular grid spacing of 0.6 $\lambda$. The black dots each represent an "open radiator" for the main beam angle chosen. FIGS. 14, 15 and 16 are for beam directions of 0°, 14.3° and 28.6°, respectively. The far-field pattern expected from each of these radiator groupings is shown as well. Only one of three phases was assigned to each radiator before the exercise began. Further reduction in sidelobe levels can be accomplished through the optimization routine, for which this is a starting point, as well as by providing a greater multiplicity of phases to the slots in the array.

Very simple changes to the adaptive algorithm can be employed to create multiple beam and difference patterns. The number of pixels only needs to be increased to tailor very sophisticated footprint patterns.

It is important to note that the adaptive technique is very powerful for a number of reasons. This approach allows for relaxed manufacturing tolerances since the array memory is programmed after complete assembly Compensation for such things as a bad radiator or impedance control device is inherent due to the optimization invoked by the algorithm. Also, the mutual coupling problem is addressed experimentally, so that very difficult calculations are avoided. Further, the often impossible theoretical calculation for conformal antenna design is handled empirically by the technique. The adaptive technique of both creating and optimizing far-field patterns is unusually powerful and flexible for these reasons.

Figure 10A:
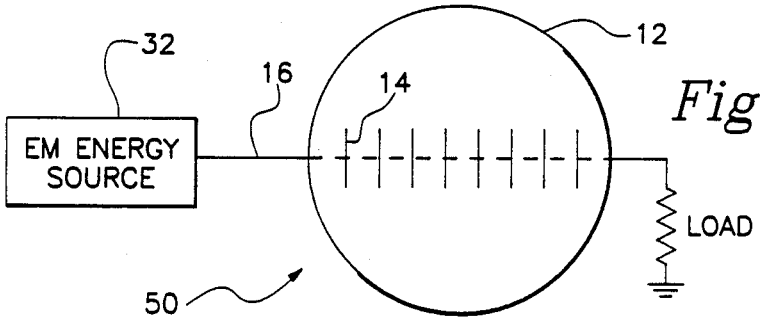
FIGS. 10*a*, 10*b* and 10*c* are alternative travelling-wave feed mechanisms useful with the invention.
Figure 10B:
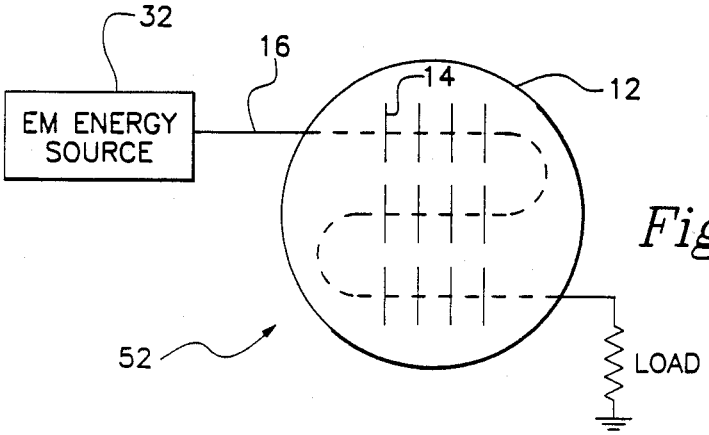
Figure 10C:
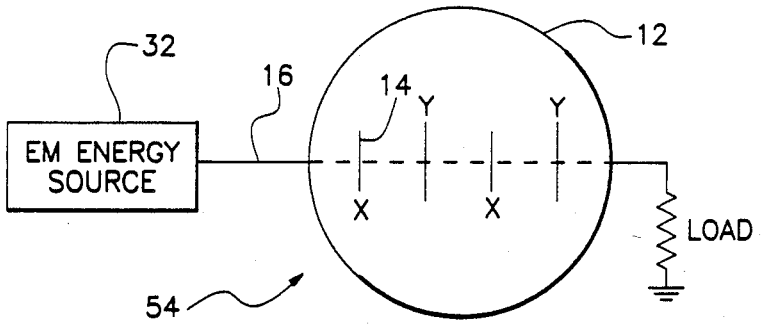

FIGS. 10*a, b* and *c* show three different configurations 50, 52 and 54 of the present invention. If the load were made to match $Z_o$ of the transmission medium, all three configurations would incorporate a travelling wave implementation. If the load were a short or an open circuit, they would incorporate a standing wave implementation. Both approaches can be realized in varying transmission media; for example: stripline, microstrip, waveguide, co-planar, coaxial, etc. Devices 50 and 54 may form one row in a series of stacked rows to form a planar array or other corporate fed version. Device 52 allows two dimensional beam steering with one feedline by wrapping the feedline back and forth. In device 54, different groups of slots (e.g., labelled as two different groups x and y) may have slots of different lengths for each group to allow the selection among a number of frequencies (i.e., a different frequency for each group). If one wishes to select group x in FIG. 10*c*, one can close group y radiators and select a far-field pattern from among the radiating elements of group x.

Figure 11A:
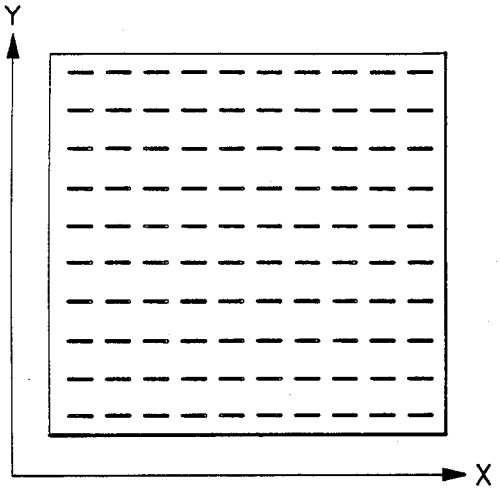
FIG. 11*a* is the total available array for the hardware built.
Figure 12A:
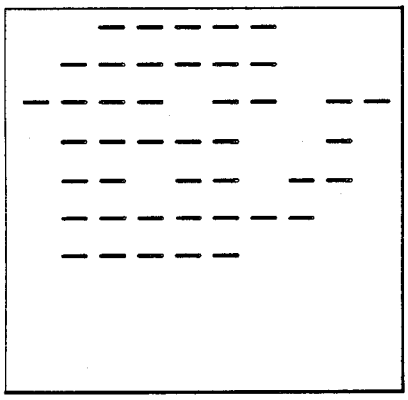
FIG. 12*a* is a first array grouping.
Figure 13A:
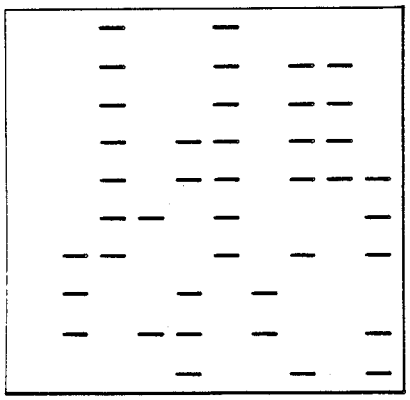
FIG. 13*a* is a second slot array grouping.
Figure 13B:
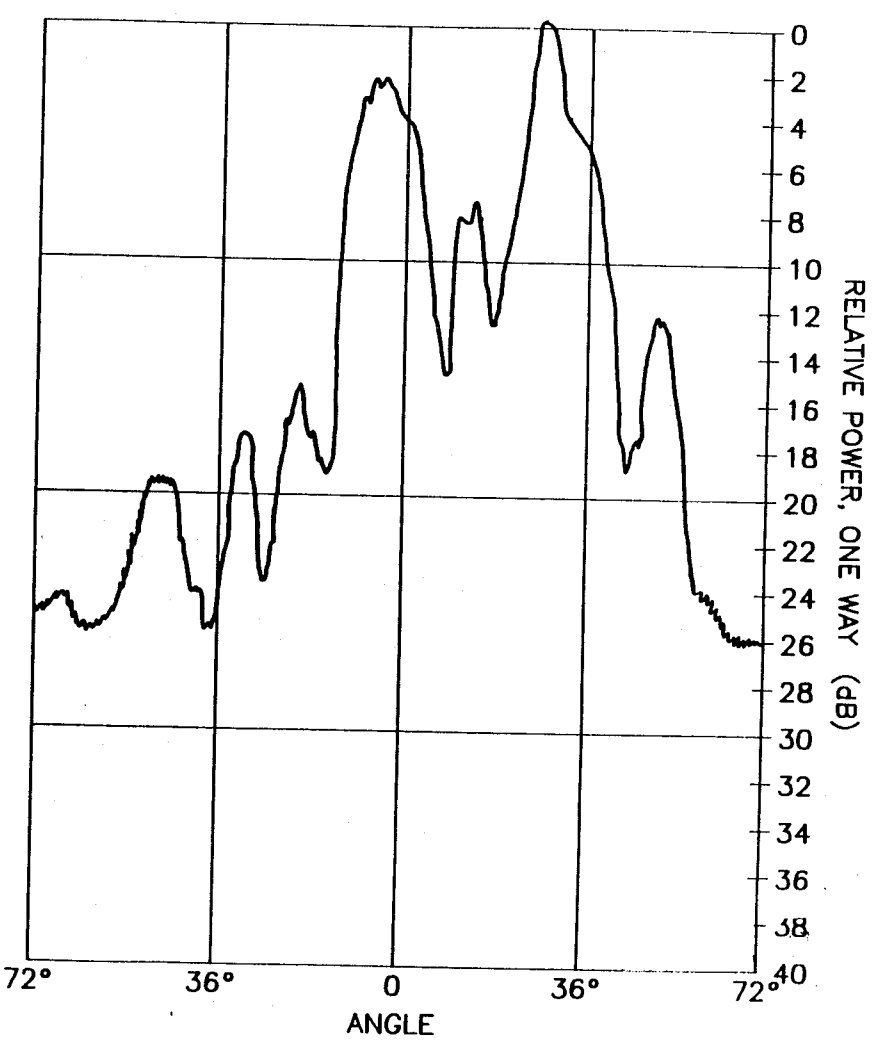
FIG. 13*b* is the measured far-field pattern resulting from the slot array grouping of FIG. 13*a*.
Figure 12B:
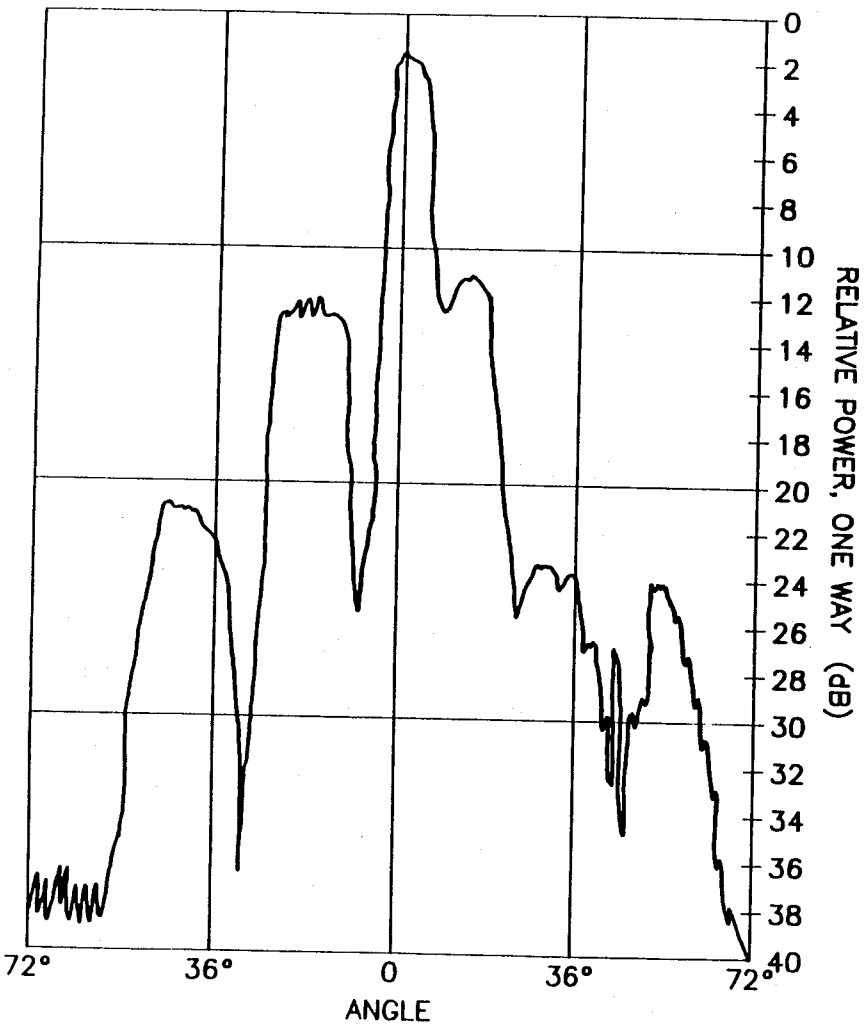
FIG. 12*b* is the measured far-field pattern resulting from the slot array grouping of FIG. 12*a*.

FIG. 11*a* reveals the total available array of slots in a hardware demonstration antenna. FIGS. 12*a* and 13*a* show two different slot patterns employed in device 10, for 0 degree and 30 degree beam positions, respectively. FIGS. 12*b* and 13*b* display the respective resultant far-field EM energy patterns. FIG. 11*b* shows the fixed phase delay at each radiator due to the phase plate.

The present invention is particularly suited for digital circuit applications by switching the diodes 18 (or junctions 42) between "on" and "off" states. However, the bias current to diodes 18(or junctions 42) may be set at a value between the on and off values to further refine the radiation patterns produced. The bias current can still be digitally controlled, while the far-field patterns can be further refined by employing the intermediate values of bias current. Analog control may also be employed. In the monolithic version of the present invention, conductive member 12 and phase plate 22 can be light-weight and thin. The monolithic version allows cost-effective realization at ultra high frequencies (i.e., millimeter wave frequencies). The weight and thickness of items 12 and 22 depend on many factors (i.e., frequency, gain/beam width requirements, environmental concerns, etc.).

The present invention has been disclosed with a few particular feed mechanisms and solid state switches to vary the slot radiation resistance of the slots. However, other feed techniques may be employed, as well as other switching means. For example, a mechanical or electromechanical switch can be used to physically move an object over the radiator, or in close proximity with the radiator, so as to change its impedance. Other electrical means such as a solid state PIN diode or transistor may be used as well. Any electrical device that can alter the radiator's conductivity, dielectric constant or permeability, may be employed in similar fashion.

The radiating element presently used in this invention is a rectangular slot opening in a conductive region. Other common slot openings are "Y" and cross shaped; however, any slot opening can be used, including an annular slot.

Methods of applying the electromagnetic energy to the slot radiator are numerous; only a few have been mentioned in this discussion.

What is claimed is:

1. An electronically steerable antenna comprising:

an array of slot-type radiators in a conductive member mounted on a phase plate of varying thickness, wherein the proximate thickness determines a phase for each of said slot-type radiators, wherein each of said slot-type radiators has an independently adjustable output amplitude and a particular fixed phase, and wherein each of said slot-type radiators has a base-emitter junction of a planar bipolar transistor that determines the impedance of each of said slot-type radiators according to a control voltage applied across the junction, thereby determining an amplitude of output radiation from each of said slot-type radiators;

an electromagnetic radiation energy source, coupled to said array of slot-type radiators, for providing electromagnetic radiation through the phase plate to said array of slot-type radiators;

control means, connected to said array of slot-type radiators, for controlling each of said slot-type radiators by applying the control voltage across the junction of each bipolar transistor of each of said radiators; and antenna programming means, connected to said control means, for indicating to said control means the amplitudes of output radiation of said slot-type radiators that form a group pattern of selected slots which have determined impedances and individual fixed phases, wherein the group pattern of selected slots has a cumulative effect of rapidly establishing a particular resultant radiated pattern for a certain direction and distance (for instance, near- or far-field) at a particular frequency.

2. Apparatus of claim 1 wherein said array of slot-type radiators including transistors for switching and controlling amplitude output of each slot-type radiator, is a monolithic integrated circuit chip.

3. Apparatus of claim 1 wherein the control voltages to the transistors may be varied to fine-tune the amplitudes of the outputs of said radiators.

4. An electronically steerable antenna comprising:

an array of slot-type radiators in a conductive member mounted on a phase plate of varying thickness, wherein the proximate thickness determines a specific phase for each of said slot-type radiators, wherein each of said slot-type radiators has an individually controllable radiation output amplitude and a particular fixed phase, and wherein each of said slot-type radiators has an associated transistor that discretely switches the respective slot-type radiator on or off through a control voltage of the associated transistor, thereby controlling the output from each of said slot-type radiators;

an electromagnetic radiation energy source, connected to said array of radiators, for providing electromagnetic radiation to said array of radiators;

control means, connected to each associated transistor, for digitally switching the control voltage to each associated transistor of said slot-type radiators thereby opening or closing the respective radiator; and antenna programming means, connected to said control means, for selecting and communicating to said control means certain said slot-type radiators to be switched on thereby forming a particular group pattern of activated radiators in said array, for rapidly establishing or changing to a desired radiated pattern in a certain direction and at a given distance for a particular frequency.

5. Apparatus of claim 4 wherein the control voltages to the associated transistors are adjusted to fine-tune the amplitudes of the outputs of said radiators.

6. Apparatus of claim 4 wherein each of said array of said slot-type radiators and each of the associated transistors for switching and controlling amplitude output of each of said slot-type radiators, is a monolithic integrated circuit chip.

7. An electronically steerable antenna comprising:

an array of slot-type radiators in a conductive member mounted on a phase plate of varying thickness, wherein the proximate thickness determines a specific phase for each of said slot-type radiators, wherein each of said slot-type radiators has an individually controllable radiation output amplitude and a particular fixed phase, and wherein each of said slot-type radiators has an associated diode that discretely switches the respective slot-type radiator on or off through a control current of the associated diode, thereby controlling the output from each of said slot-type radiators;

an electromagnetic radiation energy source, coupled to said array of radiators, for providing electromagnetic radiation to said array of radiators;

control means, connected to each associated diode, for digitally switching the control current to each associated diode of said slot-type radiators thereby opening or closing the respective radiator; and antenna programming means, connected to said control means, for indicating to said control means a selection of certain said slot-type radiators to be switched on thereby forming a particular group pattern of activated radiators in said array, for rapidly providing at said array a desired radiated pattern in a certain direction and at a given field for a particular frequency.

8. Apparatus of claim 7 wherein the control currents to the associated diodes have bias currents that may be varied to fine-tune the amplitudes of the outputs of said radiators in on and off status.

9. Apparatus of claim 7 wherein said array of slot-type radiators including diodes for switching outputs of the radiators, is a monolithic integrated circuit chip.

* * * * *